US009714564B2

(12) United States Patent
Zacharko

(10) Patent No.: US 9,714,564 B2
(45) Date of Patent: Jul. 25, 2017

(54) DEGREE OF DRILLING SHAFT DEFLECTION DETERMINATION IN A ROTARY STEERABLE DRILLING DEVICE

(71) Applicant: Halliburton Energy Services, Inc., Houston, TX (US)

(72) Inventor: Jonathan Peter Zacharko, Edmonton (CA)

(73) Assignee: HALLIBURTON ENERGY SERVICES INC., Houston, TX (US)

( * ) Notice: Subject to any disclaimer, the term of this patent is extended or adjusted under 35 U.S.C. 154(b) by 0 days.

(21) Appl. No.: 14/779,268

(22) PCT Filed: Sep. 9, 2014

(86) PCT No.: PCT/US2014/054781

§ 371 (c)(1),
(2) Date: Sep. 22, 2015

(87) PCT Pub. No.: WO2016/039731

PCT Pub. Date: Mar. 17, 2016

(65) Prior Publication Data

US 2016/0230538 A1 Aug. 11, 2016

(51) Int. Cl.

| | |
|---|---|
| ***E21B 47/024*** | (2006.01) |
| ***E21B 7/06*** | (2006.01) |
| ***E21B 3/00*** | (2006.01) |

(52) U.S. Cl.

CPC ..... *E21B 47/024* (2013.01); *E21B 3/00* (2013.01); *E21B 7/06* (2013.01); *E21B 7/062* (2013.01)

(58) Field of Classification Search

CPC . E21B 47/024; E21B 7/06; E21B 3/00; E21B 7/062

See application file for complete search history.

(56) References Cited

U.S. PATENT DOCUMENTS 5,265,682 A 11/1993 Russell et al.
6,234,259 B1 * 5/2001 Kuckes ..... E21B 7/062 175/61

(Continued)

FOREIGN PATENT DOCUMENTS

EP 0588389 B1 8/1997
EP 1489735 A2 12/2004

OTHER PUBLICATIONS

International Search Report and the Written Opinion of the International Searching Authority mailed Jun. 9, 2015 in the International Application No. PCT/US2014/054781.

*Primary Examiner* — Brad Harcourt
(74) *Attorney, Agent, or Firm* — Polsinelli PC

(57) ABSTRACT

A method for determining a configuration of a mechanical actuator coupled to a drilling shaft in a drilling shaft deflection device of a rotary steerable subterranean drill. The method includes receiving, at a controller, data representative of a present rotary position of a rotor of an electronically commutated deflector motor of a drilling shaft deflection device of a rotary steerable subterranean drill. The rotor is operatively coupled by a fixed-ratio transmission to a mechanical actuator comprising a drilling shaft receiver coupled about a portion of a deflectable drilling shaft of the drilling shaft deflection device. The method includes determining, at the controller, the present position of the drilling shaft receiver in dependence upon the received data representative of the present rotary position of the rotor of the electronically commutated deflector motor.

34 Claims, 9 Drawing Sheets

(56) References Cited

U.S. PATENT DOCUMENTS

| | | | | |
|---|---|---|---|---|
| 6,244,361 | B1 | 6/2001 | Comeau et al. | |
| 2003/0000743 | A1* | 1/2003 | Miszewski | E21B 7/067 175/92 |
| 2009/0039825 | A1 | 2/2009 | Stancu et al. | |
| 2009/0166089 | A1 | 7/2009 | Millet | |
| 2012/0273271 | A1 | 11/2012 | Stuart | |
| 2013/0088361 | A1 | 4/2013 | Pike | |
| 2014/0008125 | A1 | 1/2014 | Hay | |

* cited by examiner

DEGREE OF DRILLING SHAFT DEFLECTION DETERMINATION IN A ROTARY STEERABLE DRILLING DEVICE

CROSS-REFERENCE TO RELATED APPLICATIONS

This application is a national stage entry of PCT/US2014/054781 filed Sep. 9, 2014, said application is expressly incorporated herein in its entirety.

FIELD

The present disclosure relates generally to drilling systems, and particularly to rotary steerable drilling in oil and gas exploration and production operations. More specifically, the present disclosure relates to feedback control of a dual motor biasing device for controllably deflecting the drive shaft in a rotary steerable drilling device.

BACKGROUND

Directional drilling in oil and gas exploration and production has been used to reach subterranean destinations or formations with a drilling string. One type of directional drilling involves rotary steerable drilling systems. Rotary steerable drilling allows a drill string to rotate continuously while steering the drill string to a desired target location in a subterranean formation. Rotary steerable drilling systems are generally positioned at a lower end of the drill string and typically include a rotating drill shaft or mandrel, a housing that rotatably supports the drill shaft, and additional components within the housing that orient the toolface direction of the drill bit at the end of the drill shaft relative the housing. One method for steering the drill bit includes deflecting or bending the drill shaft within the housing so that the drill bit extends from the housing at an angle in a desired direction. At times, it can be advantageous to be able to indirectly determine the degree of deflection of the drilling string within the housing, as well as be able to set the degree of deflection of the drilling string without the requirement of direct confirmation, for example by sensor detection, within the housing.

BRIEF DESCRIPTION OF THE DRAWINGS

Implementations of the present technology will now be described, by way of example only, with reference to the attached figures, wherein.

DETAILED DESCRIPTION

Figure 1A:
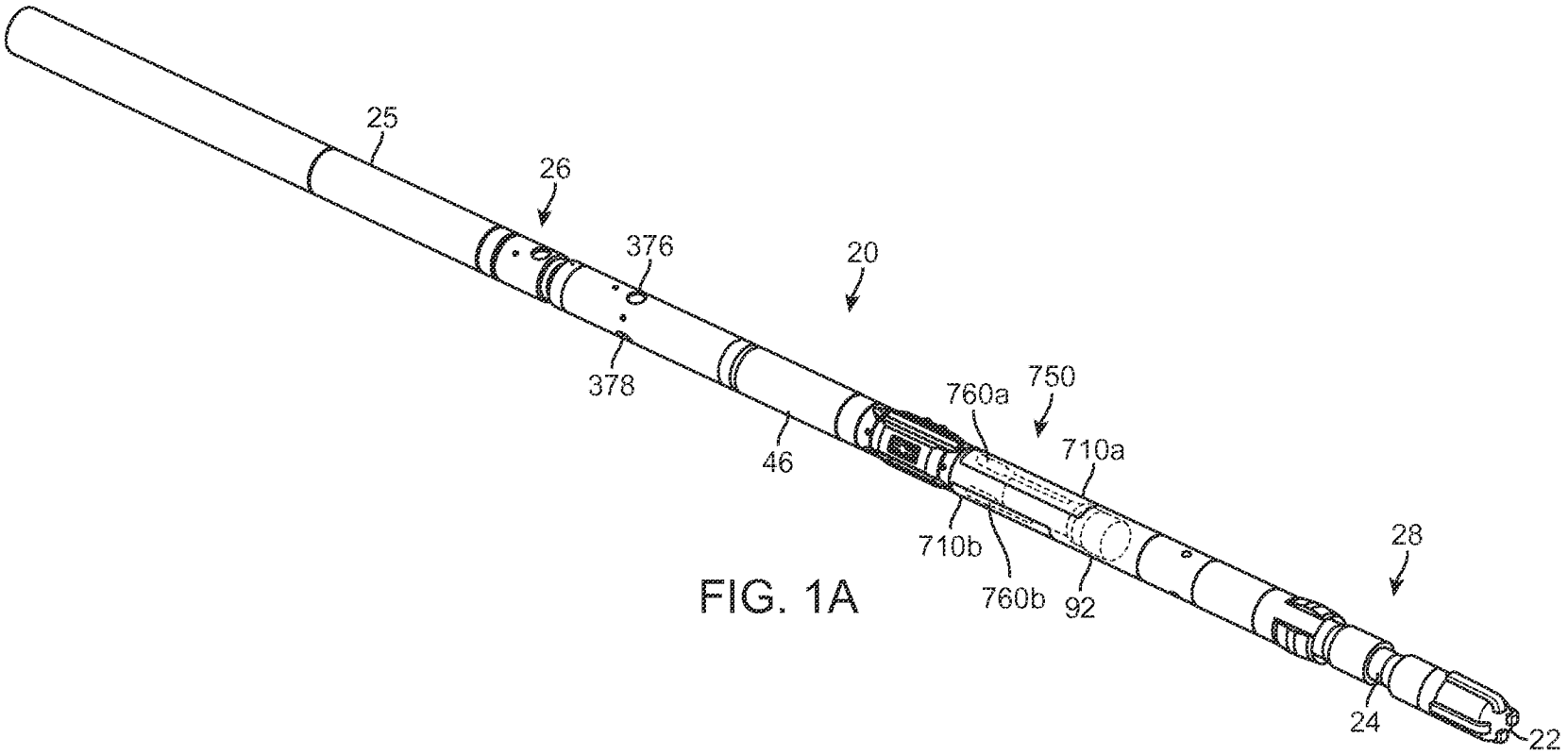
FIG. 1A is a diagram illustrating an embodiment of a rotary steerable drilling device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, and the like orientations shall mean positions relative to the orientation of the wellbore or tool. Additionally, the illustrated embodiments are depicted so that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "communicatively coupled" is defined as connected, either directly or indirectly through intervening components, and the connections are not necessarily limited to physical connections, but are connections that accommodate the transfer of data between the so-described components. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

The term "radial" and/or "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

A drilling shaft deflection device is disclosed herein for determining a deflection angle and azimuthal toolface direction of a drill bit in a rotary steerable subterranean drill. The drilling shaft deflection device can include a deflection mechanism made up of a pair of eccentric rings which can be rotated to deflect the shaft to achieve a desired configuration. An electronically commutated motor (ECM) may be employed to power the rotation of the eccentric rings and the resulting deflection angle and azimuthal toolface direction of the drill bit. The ECM can include a rotor which through a fixed-ratio transmission rotates the eccentric rings (or other deflection device). The fixed-ratio transmission may include for example spider couplings, shafts, pinions, spur gears—all of which may be coupled between the rotor and eccentric rings in a fixed ratio. Due to this fixed ratio, the degree of deflection and azimuthal toolface can be determined in dependence on the rotary position of the rotor within the ECM.

Rotary Steering Device Having a Drilling Shaft Deflection Device

Figure 1B:
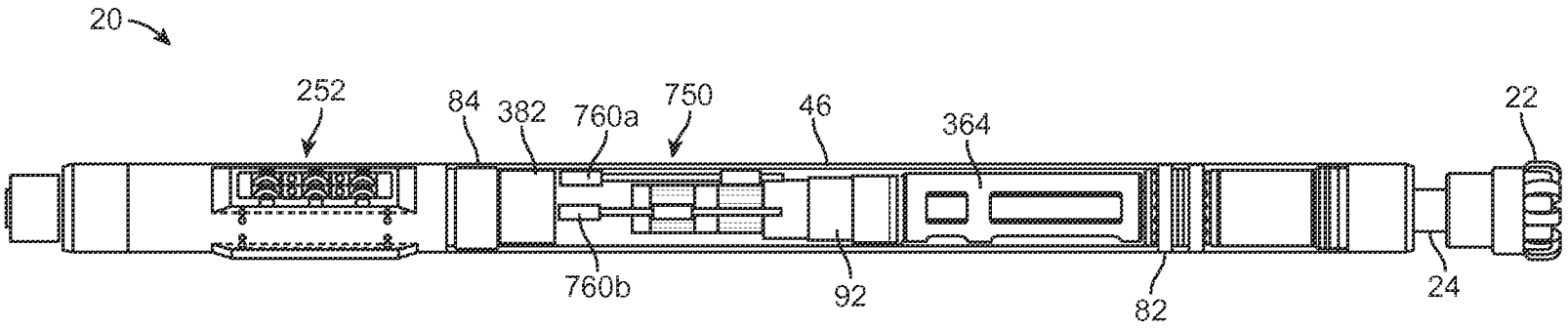
FIG. 1B is a diagram illustrating an embodiment of a rotary steerable drilling device.

One illustrative example of a directional drilling device having a drilling shaft deflection device as disclosed herein is a rotary steerable drilling device 20 shown in FIGS. 1A and 1B. The rotary steerable drilling device 20 includes a rotatable drilling shaft 24 which is connectable or attachable to a rotary drilling bit 22 and to a rotary drilling string 25 during the drilling operation. More particularly, the drilling shaft 24 has a proximal end 26 typically closest to the earth's surface via the wellbore 48 (shown in FIG. 8) and a distal end 28 deepest in the well, typically furthest from the earth's surface via the wellbore 48.

The distal end 28 of the drilling shaft 24 is drivingly connectable or attachable with the rotary drilling bit 22 such that rotation of the drilling shaft 24 by the drilling string 25 results in a corresponding rotation of the drilling bit 22. The distal end 28 of the drilling shaft 24 may be permanently or removably attached, connected or otherwise affixed with the drilling bit 22 in any manner and by any structure, mechanism, device or method permitting the rotation of the drilling bit 22 upon the rotation of the drilling shaft 24. A threaded connection may also be utilized.

The drilling shaft 24 may include one or more elements or portions connected, attached or otherwise affixed together in any suitable manner providing a unitary drilling shaft 24 between the proximal and distal ends 26, 28. In some examples, any connections provided between the elements or portions of the drilling shaft 24 are relatively rigid such that the drilling shaft 24 does not include any flexible joints or articulations therein. The drilling shaft 24 may be a single, unitary or integral element extending between the proximal and distal ends 26, 28. Further, the drilling shaft 24 is tubular or hollow to permit drilling fluid to flow therethrough in a relatively unrestricted and unimpeded manner. Note, the drill shaft 24 can also be referred to as a mandrel.

The rotary steerable drilling device 20 includes a housing 46 for rotatably supporting a length of the drilling shaft 24 for rotation therein upon rotation of the attached drilling string 25. The housing 46 may support, and extend along any length of the drilling shaft 24. However, in the illustrated example, the housing 46 supports substantially the entire length of the drilling shaft 24 and extends substantially between the proximal and distal ends 26, 28 of the drilling shaft 24.

The housing 46 may be made up of one or more tubular or hollow elements, sections or components permanently or removably connected, attached or otherwise affixed together to provide a unitary or integral housing 46 permitting the drilling shaft 24 to extend therethrough.

In order to deflect the shaft and obtain the desired deflection (bend) as well as desired azimuthal orientation of the drilling shaft 24 rotary steerable drilling device 20 additionally includes an exemplary drilling shaft deflection device 750. Received beneath the hatches 710*a*, 710*b* are one or more motors (two are shown) including for example an outer eccentric ring drive motor 760*a* and an inner eccentric ring drive motor 760*b*. The hatches 710*a*, 710*b* can be secured to the housing 46 with threaded bolts or similar releasable securement mechanisms that facilitate the hatches' 710*a*, 710*b* removal. A seal can also be provided between the hatches 710*a*, 710*b* and the housing 46 which maintains a fluid tight, closed compartment within the housing 46.

Figure 2:
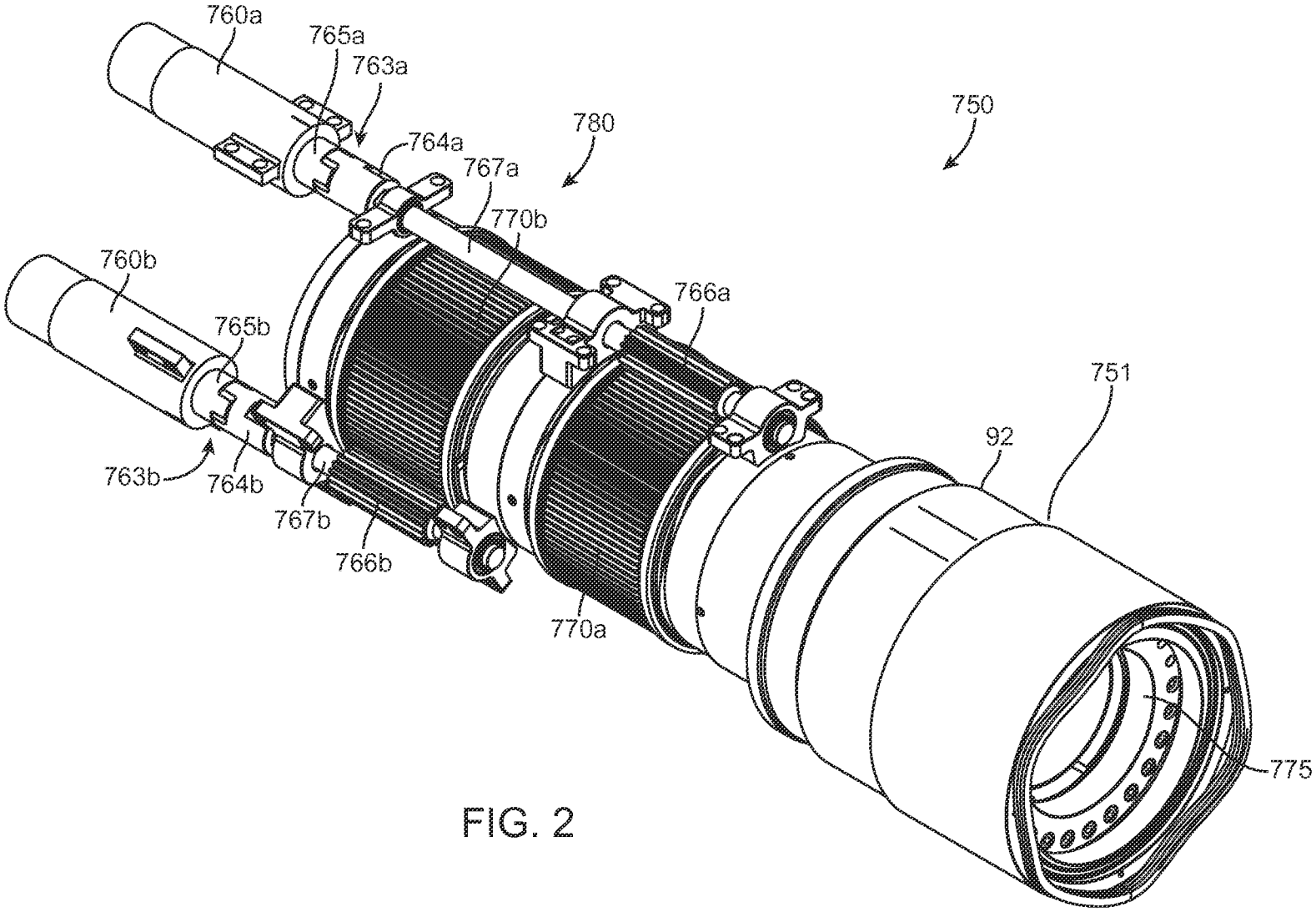
FIG. 2 is a diagram illustrating an embodiment of an internal portion of a drilling shaft deflection device having a pair of drive motors.

The outer eccentric ring drive motor 760*a* and an inner eccentric ring drive motor (760*b*) are coupled indirectly to the deflection assembly 92 via fixed-ratio transmissions (illustrated in FIG. 2). The deflection assembly 92 provides for the controlled deflection of the drilling shaft 24 resulting in a bend or curvature of the drilling shaft 24 in order to provide the desired deflection of the attached drilling bit 22. The orientation of the deflection of the drilling shaft (24) may be altered in order to change the orientation of the drilling bit 22 or toolface, while the magnitude of the deflection of the drilling shaft 24 may also be altered to vary the magnitude of the deflection of the drilling bit 22 or the bit tilt relative to the housing 46. As described below the deflection assembly can include eccentric rings.

The outer eccentric ring drive motor 760*a* and an inner eccentric ring drive motor 760*b* may be ECMs. As discussed in more detail below, the use of built in features and commutative information of ECMs, along with the fixed ratio coupling to the deflection assembly 92, permits determination of the relative orientation of the deflection of the drilling shaft effected by the deflection assembly 92.

During drilling, the rotary steerable drilling device 20 is anchored against rotation in the wellbore which would otherwise be imparted by the rotating drilling shaft 24. Anti-rotation device 252 or any mechanism, structure, device or method capable of restraining or inhibiting the tendency of the housing 46 to rotate upon rotary drilling may be used. Advantageously, wheels resembling round pizza cutters can be employed that extend at least partially outside the rotary steerable drilling device 20 and project into the earth surrounding the borehole.

The distal end includes a distal radial bearing 82 which included a fulcrum bearing, also referred to as a focal bearing, or some other bearing which facilitates the bending of the drilling shaft 24 at the distal radial bearing location upon the controlled deflection of the drilling shaft 24 by the rotary steerable drilling device 20 to produce a bending or curvature of the drilling shaft 24.

The rotary steerable drilling device 20 has at least one proximal radial bearing 84 which is contained within the housing 46 for rotatably supporting the drilling shaft 24 radially.

The housing orientation sensor apparatus 364 can contain an ABI or At-Bit-Inclination insert associated with the housing 46. Additionally, the rotary steerable drilling device 20 can have a drilling string orientation sensor apparatus 376. Sensors which can be employed to determine orientation include for example magnetometers and accelerometers. The rotary steerable drilling device 20 also optionally has a releasable drilling-shaft-to-housing locking assembly 382 which can be used to selectively lock the drilling shaft 24 and housing 46 together.

Further, in order that information or data may be communicated along the drilling string 25 from or to downhole locations, the rotary steerable drilling device 20 can include a drilling string communication system 378.

Drilling Shaft Deflection Assembly Having an ECMElectric sensors can be applied and positioned around the housing (46) and shaft (24) to sense the degree of deflection as well as azimuthal direction. Such sensors include rotating magnet sensors, magnetometers and accelerometers. However, with the employment of the drilling shaft deflection device 750 described herein, there is a reduced need for sensors. In particular, when ECMs are used, no sensors may be needed other than that for determining the position of the ECM rotor, and which is often built-in to the ECM unit.

The drilling shaft deflection device 750 is shown in FIG. 2 with the housing removed, exposing the internal portion of the deflection device 750. Shown also are the outer eccentric ring drive motor 760*a* and an inner eccentric ring drive motor 760*b*. The drive motors 760*a*, 760*b* can be substantially cylindrical and small relative the size and diameter of the housing 46. The drive motors 760*a*, 760*b* can be housed in a motor housing which provides a surface which substantially contains the contents of the drive motor components. The drive motor housing is radially offset aside the longitudinal centerline of the housing 46. Further, the motor housing of drive motors 760*a*, 760*b* can be anchored to the housing 46 located proximate thereto. The motor housing of the drive motors 760*a*, 760*b* can be circumferentially spaced apart one from another about the housing 46. In such case, the motor housing of the drive motors 760*a*, 760*b* can be circumferentially spaced apart, one from another, by any degree, including about 45 degrees, or about 60 degrees, or about 70 degrees, or about 90 degrees, or about 120 degrees, or about 180 degrees, and in some examples less than about 90 degrees, or less than about 180 degrees around the housing 46.

Any type of motor may be used capable of providing rotational bias or to power to the eccentric rings of the deflection assembly 92, including but not limited to hydraulic motors and electric motors. However, the motor should have a rotor and a mechanism to detect or determine the position of the rotor. Suitable electric motors include AC motors, brushed DC motors, piezo-electric motors, and electronically commutated motors (ECM). The term ECM can include all variants of the general class of electronically commutated motors, which may be described using various terminology such as a brushless DC (BLDC) motor, a permanent magnet synchronous motor (PMSM), an electronically commutated motor (ECM/EC), an interior permanent magnet (IPM) motor, a stepper motor, an AC induction motor, and other similar electric motors which are powered by the application of a varying power signal, including motors controlled by a motor controller that induces movement between the rotor and the stator of the motor.

An ECM, as disclosed herein, does not require brushes or contacts between the rotor and the stator. Advantageously, an ECM can be relatively simple in construction; however the motor controller component of an ECM may be relatively complex. Additionally, an ECM is well suited for applications which require maintenance-free operation or high rotation speeds. An ECM also provides certain capabilities not available with a brushed motor, including precise speed limiting, positioning and control such as establishing micro-stepped operations for slow and/or fine motion control. Such features foster reliability and facilitate serviceability by reducing the number of parts and components and decreasing service time. Additionally, due to the relatively small size of ECMs and the flexibility in arranging the motors and the associated components on the rotary steerable drill 20, the overall length of the drilling shaft deflection device can be minimized, and thus take up less space.

Figure 3:
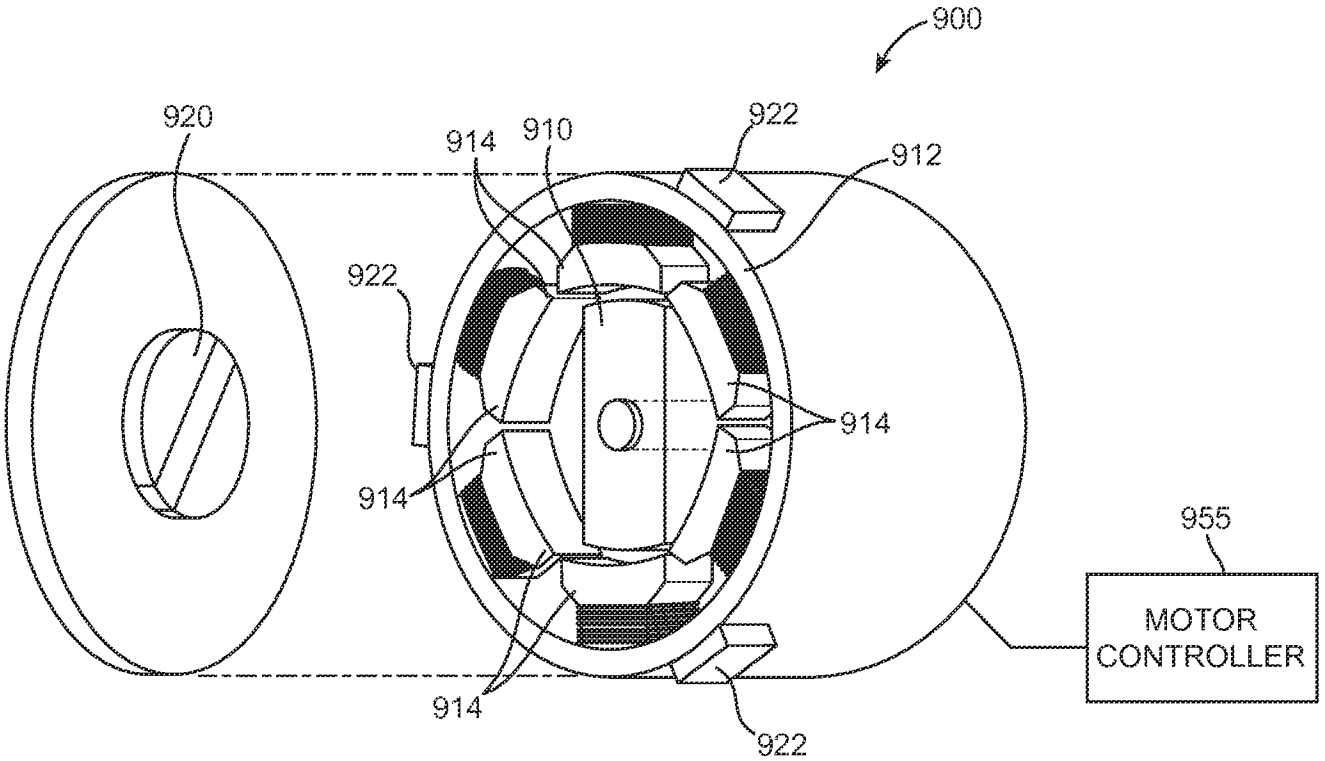
FIG. 3 is a diagram illustrating an embodiment of a simplified electronic commutated motor.

In some examples the ECM can have built-in features which are inherent or included in the device. For example, the ECM can optionally have a braking mechanism, such as a detent brake, to prevent movement of the output shaft of the motor when the ECM is not being purposefully rotated. An additional built-in feature can include a feedback mechanism such as an included resolver or associated Hall effect sensors that track the position of the rotor relative to the stator in order to facilitate operation of the ECM by the motor controller. A simplified version of component parts of an ECM 900 is shown in FIG. 3. Illustrated therein is a rotor 910 made up of a magnet and a stator 912 made up of a series of coiled stator pieces 914 surrounding the rotor 910. The relative position of the rotor 910 is used by a motor controller 955 for electric commutation of the rotor 910. A resolver 920 may be used to determine this rotor position, and in particular the degrees of rotation. Alternatively, or in addition to the resolver 920, Hall effect sensors 922 can be employed to detect the position of the rotor 910. In some examples, only one Hall effect sensor need be used, while in other examples a number of Hall effect sensors can be used making up one Hall effect sensor unit, or such Hall effect sensors can be used with a resolver. In still other examples, sensors can be omitted altogether, for instance by employing sensorless commutation techniques used in ECM applications. Sensorless commutation techniques include "field oriented control" ("FOC") or "vector mode control." FOC is a control feature performed by the motor controller or other processing device for commutation of the motor. With the sensorless or built-in sensing function of the ECM for electric commutation of the rotor (910), this same information can be employed for determining actuation position of the eccentric rings of the deflection assembly (92).

Figure 4:
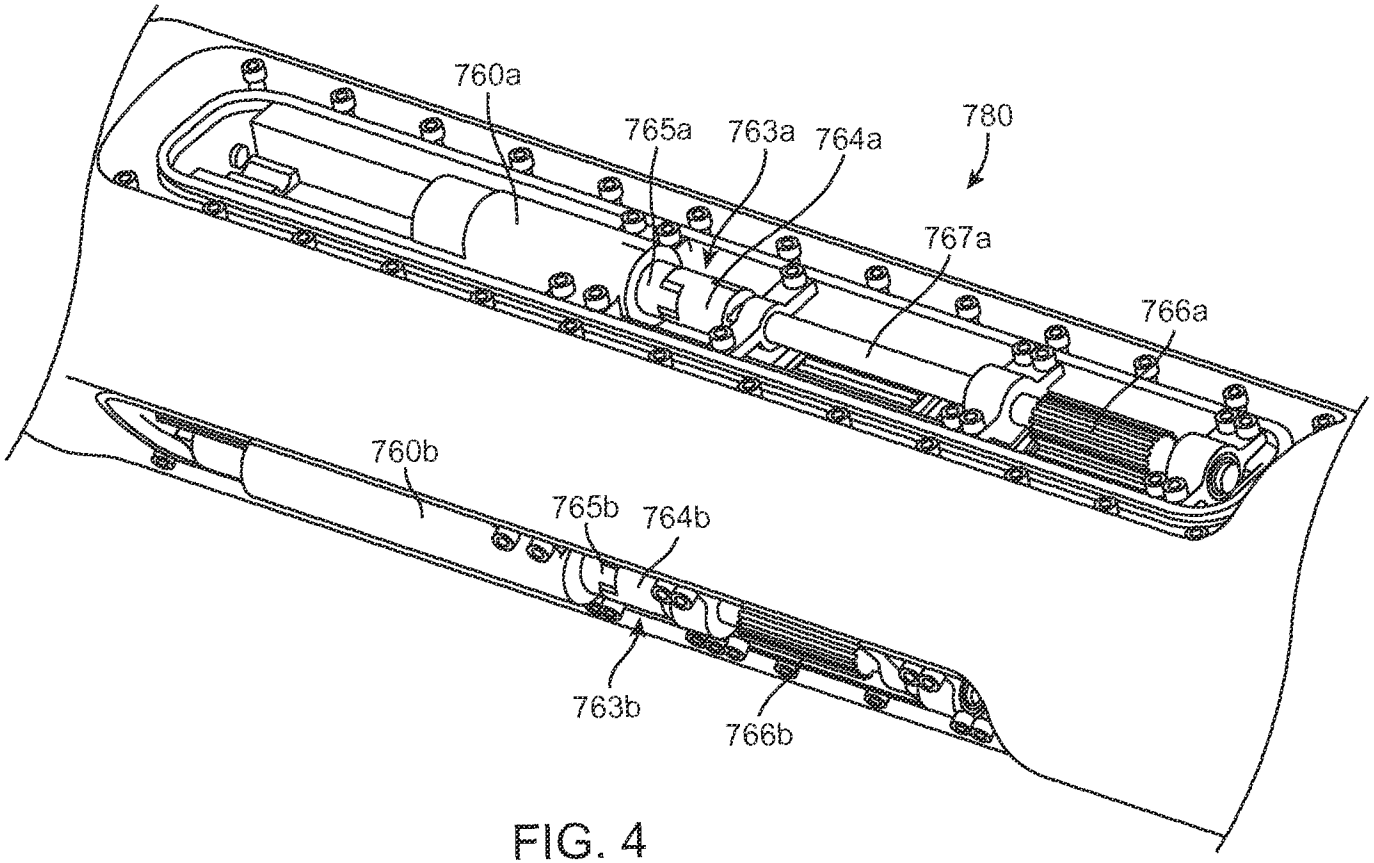
FIG. 4 is a diagram illustrating an embodiment of a portion of a drilling shaft deflection device having a pair of drive motors.
Figure 5:
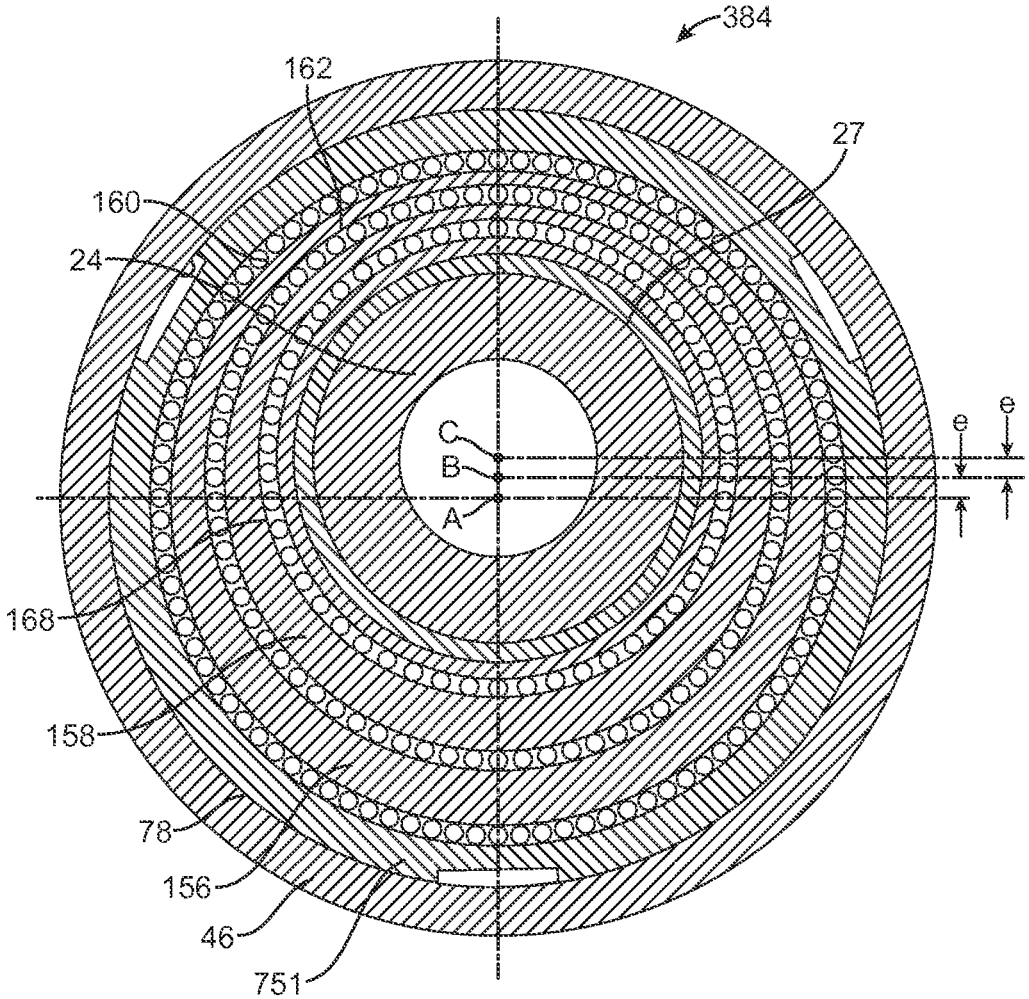
FIG. 5 is a diagram of a drilling shaft deflection assembly, including a rotatable outer eccentric ring and a rotatable inner eccentric ring.
Figure 6:
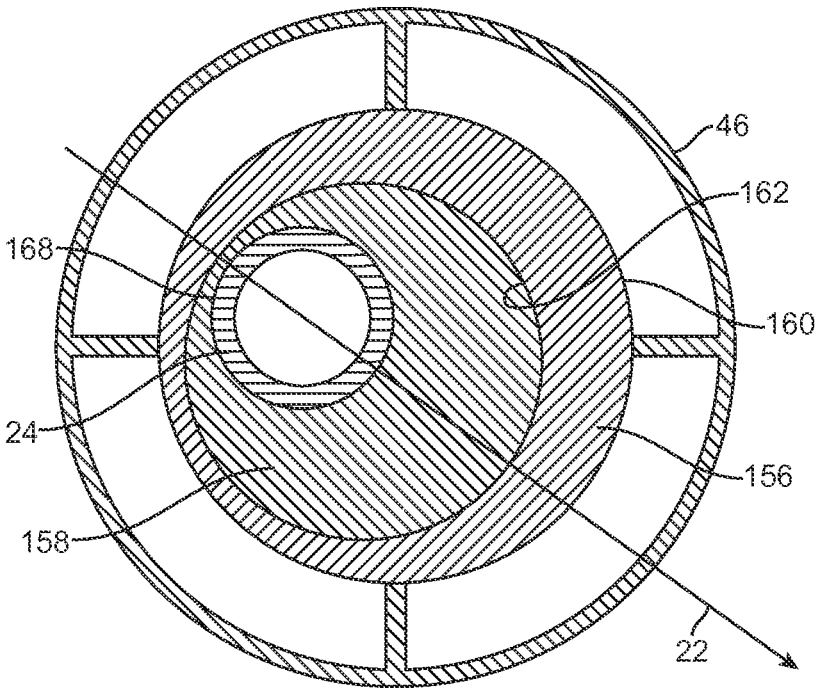
FIG. 6 is a diagram of a drilling shaft deflection assembly that exaggerates the offset position of the drilling shaft relative the housing.

Referring back to FIG. 2, the drive motors 760*a*, 760*b* are connected indirectly to the eccentric rings (eccentric rings are illustrated in FIGS. 5 and 6) by fixed-ratio transmissions 780, or transmission components. These are fixed in their gear ratios such that upon rotation of a rotor within motors 760*a*, 760*b* the fixed-ratio transmissions 780 transmit the rotor's rotation to the mechanical actuator at a particular ratio. The transmissions include for example, spider couplings, shafts, pinions, spur gears further outlined and defined hereinbelow in FIGS. 2 and 4. In particular, the drive motors 760*a*, 760*b* are each coupled to a pinion 766*a*, 766*b* via upper spider coupling 763*a* and lower spider coupling 763*b*. The spider couplings 763*a*, 763*b* are each made up of opposing interlocking teeth which communicate rotation from the drive motors 760*a*, 760*b* to a set of pinions 766*a*, 766*b*. The upper coupling portion 765*a*, 765*b* of each spider coupling 763*a*, 763*b* includes a series of teeth and channels that engage a similar (mirror image) series of teeth and channels on the lower coupling portion 764*a*, 764*b* of each spider coupling 763*a*, 763*b*. There can be drive shafts 767*a*, 767*b* which extend from the lower coupling portion 764*a*, 764*b* to an outer eccentric ring pinion 766*a* and inner eccentric ring pinion 766*b*. The respective pinions 766*a*, 766*b* are each splined, having gear teeth that engage with an outer eccentric ring spur gear 770*a* and inner eccentric ring spur gear 770*b*. The spur gears 770*a*, 770*b* are each splined, having gear teeth that surround the entire peripheral edge of the respective gear and receive the teeth from pinions 766*a*, 766*b*. The spur gears 770*a*, 770*b* can have substantially the same diameter, with a circumference less than that of the housing 46, and may also be the same or greater than the outer eccentric ring 156.

The pinions 766*a*, 766*b* are positioned adjacent the spur gears 770*a*, 770*b*, at their periphery, so that pinion teeth intermesh with spur gear teeth as shown in FIG. 2. The motors 760*a*, 760*b* provide rotational driving force that is communicated through the spider coupling 763*a*, 763*b* and drive shafts 767*a*, 767*b* causing rotation of the pinions 766*a*, 766*b*. The rotating pinions 766*a*, 766*b* engage and rotate the spur gears 770*a*, 770*b*. The spur gears 770*a*, 770*b* can be connected directly or indirectly to the outer and inner eccentric rings 156, 158 contained within the body of the deflection device 750. For example, spur gears 770*a*, 770*b* can be bolted to inner and outer eccentric rings 156, 158 (eccentric rings illustrated in FIG. 2 discussed below). In the illustrated example, the outer eccentric ring spur gear 770*a* is coupled to the outer eccentric ring 156 via a linkage, which may take the form or an interconnected cylindrical sleeve. The inner eccentric spur gear 770*b*, however, is coupled to the inner eccentric ring 158 via an Oldham coupling. The Oldham coupling permits off-center rotation and the necessary orbital motion of the inner eccentric ring 158 relative the housing 46.

The inner eccentric ring spur gear 770*b* permits deflection or floating of the drilling shaft (24) held in the interior aperture of the inner eccentric ring 156. As the drilling shaft 24 orbits about within the housing 46 as the orientations of the eccentric rings change, the powering transmission, at least to the inner eccentric ring 156, must shift in order to maintain connection to the ring 156, and this is accomplished by use of the Oldham coupling.

In the illustrated embodiment of FIG. 2, the drive motors 760*a*, 760*b* are positioned at the top or proximal end (left side of the FIG. 2) of the drilling shaft deflection device 750. As shown, the outer eccentric ring pinion 766*a* is positioned further down, toward the distal end of the drilling shaft deflection device 750. The drive motors 760*a*, 760*b* can also be lengthwise offset, one from the other, relative the housing 46.

The outer eccentric ring spur gear 770*a* and inner eccentric ring spur gear 770*b* are positioned adjacent one another, but with the outer eccentric ring spur gear 770*a* positioned further along the body in the distal direction. FIG. 4 illustrates another view of the drilling shaft deflection device and positioning of the motors 760*a*, 760*b*, shafts 767*a* and pinions 766*a*, 766*b* are located. As illustrated, the hatch covers 710*a*, 710*b* shown in FIG. 1A has been removed. Further, one hatch is longer than the other and extends a further distance toward the distal end of the drilling shaft deflection device. This is dictated by the position of the outer eccentric ring pinion 766*a* being further down, closer to the eccentric rings, than the inner eccentric ring pinion 766*b*. However, alternatively, the inner eccentric ring pinion 766*b* and inner eccentric ring spur gear 770*b* can be positioned closer to the eccentric rings than the outer eccentric ring pinion 766*a* and outer eccentric ring spur gear 770*a*.

Deflection Mechanism

As previously noted, the drive motors 760*a*, 760*b* are connected indirectly to the deflection assembly 92 by fixed-ratio transmissions 780, or transmission components. As shown in the exemplary embodiment illustrated in FIG. 5, the deflection assembly 92 has a deflection mechanism 384 made up of a double ring eccentric mechanism. The eccentric rings may be located at a spaced apart distance from one another along the length of the drilling shaft 24. However, in the illustrated example, the deflection mechanism 384 is made up of an eccentric outer ring 156 and an eccentric inner ring 158, provided one within the other at the same axial location or position along the drilling shaft 24, within the housing 46. Rotation of one or both of the two eccentric rings 156, 158 imparts a controlled deflection of the drilling shaft 24 at the location of the deflection mechanism 384.

The eccentric rings contain a drilling shaft receiver 27 which receives and is coupled about the drilling shaft 24 passing therethrough. The central axis of the drilling shaft 24 and the drilling shaft receiver 27 substantially coincide. The outer ring 156, and also the circular outer peripheral surface 160 of the outer ring 156, may be rotatably supported by or rotatably mounted on, directly or indirectly, the circular inner peripheral surface 78 of the housing 46. When indirectly supported, there can be included for example an intermediate housing 751 between the outer ring 156 and inner peripheral surface 78 of the housing 46.

The circular inner peripheral surface 78 of the housing 46 is centered on the center of the drilling shaft 24, or the rotational axis "A" of the drilling shaft 24, when the drilling shaft 24 is in an undeflected condition or the deflection assembly 92 is inoperative. The circular inner peripheral surface 162 of the outer ring 156 is centered on point "B" which is offset from the centerlines of the drilling shaft 24 and housing 46 by a distance "e."

The circular inner peripheral surface 168 of the inner ring 158 is centered on point "C", which is deviated from the center "B" of the circular inner peripheral surface 162 of the outer ring 156 by the same distance "e". As described, the degree of deviation of the circular inner peripheral surface 162 of the outer ring 156 from the housing 46, defined by distance "e", is substantially equal to the degree of deviation of the circular inner peripheral surface 168 of the inner ring 158 from the circular inner peripheral surface 162 of the outer ring 156, also defined by distance "e".

Upon the rotation of the inner and outer rings 158, 156, either independently or together, the center of the drilling shaft 24 may be moved with the center of the circular inner peripheral surface 168 of the inner ring 158 and positioned at any point within a circle having a radius equal to the sum of the amounts of deviation of the circular inner peripheral surface 168 of the inner ring 158 and the circular inner peripheral surface 162 of the outer ring 156.

In other words, by rotating the inner and outer rings 158, 156 relative to each other, the center of the circular inner peripheral surface 168 of the inner ring 158 can be moved to any position within a circle having the predetermined or predefined radius as described above. Thus, the portion or section of the drilling shaft 24 extending through and supported by the circular inner peripheral surface 168 of the inner ring 158 can be deflected by an amount in any direction perpendicular to the rotational axis of the drilling shaft 24.

A simplified and exaggerated expression of the drilling shaft 24 deflection concept is illustrated in FIG. 6. As depicted, the orientation of the rings 156, 158 causes deflection of the drilling shaft 24 in one direction thereby tilting the drilling bit 22 in the opposite direction relative to the centerline of the deflector housing 46.

In practice, a control signal is sent to one or both motors 760*a*, 760*b* which then actuates and applies a rotating force through one or both spider couplings 763*a*, 763*b* to drive the shafts 765*a*, 765*b* that rotate their respective pinions 766*a*, 766*b*. The pinions 766*a*, 766*b* engage and rotate their respective spur gears 770*a*, 770*b*, which communicate rotation to the respective eccentric rings 156, 158. In this way, the eccentric rings can be singly, or simultaneously rotated from a position in which the axial centers are aligned (i.e., "e" minus "e" equals zero) to any other desired position within a circle having a radius of "2e" around the centerline A of the housing 46. In this way the drilling shaft 24 is deflected at a desired angle. That is, the amount of deflection is affected based on how far the drilling shaft 24 is radially displaced (pulled) away from the centerline of the housing 46. The degree of radial displacement can be affected by rotation of one or both of the eccentric rings 156, 158, in either direction.

Motor-Actuator Control and Feedback Loop

As discussed above with respect to the ECM 900 illustrated in FIG. 3, one or more feedback sensors can be used which are built-in to the one or more ECMs and which are used for operation of the ECM and can be used to determine the position of the eccentric rings, the deflection, or azimuthal direction of the shaft and drill bit. In some examples, no additional sensors within the motor or rotary steerable drilling system are needed. In particular, the same sensor(s) and functions which are used for producing the commutative information relating to the operation of the ECM can also be used to track incremental changes in the position of a mechanical actuator, i.e., the eccentric rings.

By the interaction of the ECM 900 of FIG. 3 with the fixed-ratio transmissions 780 shown in FIG. 2, through to the mechanical actuator 384 of FIG. 5 positional information of the mechanical actuator 384 can be determined. In particular, the information obtained by the resolver 920 of the ECM 900 or other position sensors can be used by the motor controller 955 to determine and control the mechanical actuator 384 position. This is possible due to fixed gear ratios of the fixed-ratio transmissions 780 between the ECM 900 and the mechanical actuator 384. The motor controller 955 can actuate fixed-ratio transmissions 780, for example, components that convey motive power to the eccentric rings 156, 158, and can include the aforementioned spider couplings 763*a*, 763*b*, pinions 766*a*, 766*b*, or spur gears 770*a*, 770*b*, or other transmission components coupled to the mechanical actuator 384 for deflecting or indexing the shaft 24.

For control of the eccentric rings 156, 158, a sensor, such as a resolver 920, can measure the cumulated number of rotor 910 rotations and position in the ECM required for one full rotation of the eccentric ring 156, 158. The sensor can be built into the ECM, and can be inside or outside the housing of the ECM. Whereas typically a sensor need only detect one rotation of the rotor of the ECM to carry out ordinary commutation, in the present example, the cumulated rotations of the rotor required to rotate the eccentric ring or other mechanical actuator are detected and received at the motor controller. Generally the ECM will require multiple rotor revolutions to turn the eccentric ring one full rotation, by means of the resolver or other sensor, the motor controller tracks the position and number of rotations throughout the life of the ECM relative the corresponding rotation of the eccentric rings.

Accordingly, the motor controller 955 of the ECM uses the commutation information obtained from the resolver 920 to track the corresponding incremental changes to the position of the eccentric ring. This is possible due to the fixed ratio transmissions 780 between the ECM's rotor and eccentric rings 156, 158. Unlike other biasing mechanisms such as clutch systems, the transmissions herein have no slip between each linkage because the system employs fixed gears; namely, reciprocally engaged teeth or splines between gears. Accordingly, there is a fixed gear ratio between each of the transmission components, for example from the ECM rotor to the spider couplings 763*a*, 763*b*, and from there to the pinions 766*a*, 766*b*, and subsequently to the spur gears 770*a*, 770*b*, and finally the eccentric rings 156, 158. Therefore, for every full or partial rotation, or multiple rotations of the ECM rotor 910, there is a direct and fixed amount of rotation of the associated eccentric ring. Accordingly, the resolver 920 provides position information of the ECM rotor 910 as a part of the commutation process, which in turn can be used to control the rotational position of the eccentric ring.

The connection between the rotor 910 and the mechanical actuator 384 will have a particular gear reduction ratio. This means that the rotor 910 will rotate many more times than the components of some of the fixed-ratio transmissions 780 or eccentric rings 156, 158. This ratio can be presented as revolutions of the rotor per revolutions of the mechanical actuator (eccentric rings 156, 158) or one of the transmission components. For example, the fixed-ratio transmissions can have a 15,000:1 ratio reduction, alternatively a 10,000:1 ratio reduction, alternatively a 6,000:1, alternatively a 5,000:1; alternatively a 4,000:1 from the motor to the mechanical actuator or one of the transmission components. In some examples, the rotation of the ECM rotor 910 is tracked by the motor controller 955 throughout the entire life of the ECM 900 and drilling shaft deflection device 750. Accordingly the fixed ratio transmission is maintained between the ECM rotor 910 and the eccentric ring 156, 158 and monitored by the motor controller 955.

In some examples, in place of a resolver, a Hall effect sensor or sensors 922 can be employed, built-in or proximate the ECM 900. The Hall effect sensors 922 provide positional information of the ECM rotor 910 similar to the resolver 920. The exact placement of the Hall effect sensors or resolver can depend on the sensitivity or the particular build of the ECM. Alternatively, sensors can be dispensed with altogether by use of the energized phase of the motor to infer where the rotor is in its rotation. In other examples, the motor can employ "field oriented control", also known as "vector mode control."

Additionally as a built in function, the ECM 900 can have a braking mechanism, for example a detent brake. Such a brake prevents movement of the output shaft of the motor when the motor is not operating. Additionally, the transmissions 780 can have self-locking mechanisms to achieve the same effect as the detent brake. Such brakes cause the eccentric rings to be locked in place, consequently also maintaining a particular deflection or azimuthal direction of the drilling shaft and bit. Accordingly, in addition to controlling the rotation of the eccentric rings, the built-in functions can also be employed to lock the eccentric rings in position.

In practice, if an operator wished to deflect the shaft 24 a particular degree, and/or rotate the toolface to a particular azimuthal position, the operator sends a signal from the operator surface controller to the motor controller 955 of the ECM 760*a*, 760*b*. The motor controller 955 then determines the position of the rotor 910, for example, by receiving data representative of the rotary position of the ECM rotor 910. For example, the sensor within the ECM 900 detects the position of the rotor 910 and transmits a signal or data representative of the position to the motor controller 955 thereby indicating the position. The motor controller 955 can then use this as a first position. The first position can also be determined based on post-start rotary data from the start rotary position (the initial rotary position in the life of the ECM) which is stored in memory elements of the motor controller. For example, and further discussed below, based on information from the resolver over the entire life of the motor, from its inception to the first position, the motor controller would determine the cumulated position of the rotor, i.e., the number of times it has rotated and in which direction. Accordingly, by any of the aforementioned ways or any other manner there is received at the motor controller data representative of the rotary position of the rotor.

To achieve the requested deflection and/or azimuthal direction by the operator surface controller, the motor controller 955 sends a signal to rotate the rotor 910 from a first rotary position to a second rotary position. When rotated to the second position, a sensor, such as a resolver 920 can be used to detect and send the requisite signal or data to the motor controller 955. The motor controller 955 then determines the amount of rotation that was experienced by the rotor 910 revolving from the first rotary position to the second rotary position.

Due to the fixed-ratio transmission 780 from the rotor 910 to the eccentric rings 156, 158, the path of travel of the drilling shaft receiver 27 in the eccentric rings 156, 158 can be determined based on the rotation of the rotor 910 from the first rotary position to the second rotary position of the rotor 910. The path of movement of the drilling shaft receiver 27 can be input and known in the motor controller, as it is fixed within the eccentric rings 156, 158, and travels along a fixed path within the confines of the eccentric rings 156, 158. Accordingly, the motor controller 955 applies the transmission ratio to the determined amount of rotation experienced by the rotor 910 revolving from the first to the second rotary position. From this, the motor controller 955 determines the amount of movement the drilling shaft receiver 27 had along its path of travel, which was induced by the transmission components as the rotor 910 rotated from the first rotary position to the second rotary position. As the drilling shaft receiver 27 has the drilling shaft 24 received therein, the drilling shaft deflection and azimuthal direction can also be determined by the motor controller 955 at each of the first and second rotary positions. When arriving at the second rotary position, this then becomes the present rotary position. In this way, the motor controller 955 controls and receives feedback regarding the rotor 910, drilling shaft receiver 27, and shaft 24 deflection and rotation.

A pre-calculation can also be conducted by the motor controller 955 prior to rotating from the first rotary position to the second rotary position. In advance, and due to the fixed-ratio transmissions 780, the motor controller can calculate the number of rotor rotations required to move the drilling shaft receiver 27 to achieve a desired deflection or azimuthal direction. Once calculated, the motor controller 955 can then send signals or commands to the rotor 910 to rotate a specific number of rotations from the first rotary position to the second rotary position. The feedback control discussed above can also be implemented.

As noted above, data regarding the position of the rotor 910 and drilling shaft receiver 27 can be stored in the motor controller over the life of the ECM 900. In particular, data representative of the starting rotary position at its initial inception and first installation can be received and stored in the controller, whether detected by a sensor or otherwise input. The corresponding position of the eccentric rings 156, 158 and drilling shaft receiver 27 at the start rotary position can also be determined and received in the motor controller 955. Further, data representative of the sequential, post start rotary positions, from the start rotary position all the way to the present rotary position just discussed can be received in the motor controller 955. Further based on the start and present rotary position data, the motor controller 955 can determine the cumulated amount of sequential, post-start rotations experienced by the rotor 910. The motor controller 955 can also apply the transmission ratio to the cumulated amount of post-start rotations to determine movement of the drilling shaft receiver 27 along its known path, and determine the present position of the drilling shaft receiver 27.

This can be applied to one or more ECMs, with each associated motor controller, or a global controller conducting the control. By operating ECMs in this manner precise control of the eccentric rings and drilling shaft receiver can be obtained. As a result, the shaft deflection and azimuthual direction is precisely controlled.

In case of error or loss of rotor position or eccentric ring position, each eccentric ring or other actuator may have an absolute reference position sensor (i.e., a home position sensor). Such a sensor can include a Hall effect sensor and a reference magnet. By measuring against the absolute reference position, the position of the eccentric ring can be determined and/or the ratio and position of the rotor as it corresponds to the position of the eccentric rings and drilling shaft receiver can be recalculated. Alternatively, the electromechanical actuator system could also use other physical parameters to achieve the same effect. These other physical parameters can include known limits of travel of the mechanical actuator component, or measured motor torque at known locations or configurations by the motor controller.

For example, by rotating the eccentric ring as far as it can rotate in each rotational direction, its limits can be determined. This can be related to the rotor position in the ECM or provide a basis for sensorless positional calculation.

Figure 7:
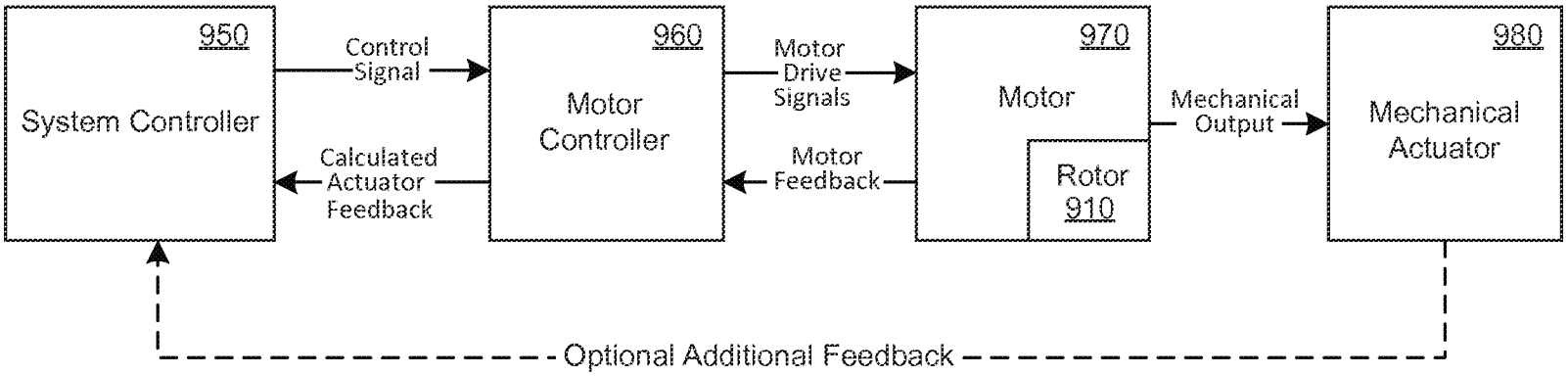
FIG. 7 is a diagrammatic flowchart for control of a drilling shaft deflection device as illustrated for example in FIGS. 2 and 4.

Referring to FIG. 7, there is illustrated a flow diagram for control of the mechanical actuator via use of the ECM 900. As discussed herein, the mechanical actuator includes eccentric rings. The system can begin for example with block 950 wherein there is shown a system controller. The system controller can be a controller or communication system on the surface that is engaged by a surface operator to position and control the drill string to a desired target. The system controller can send a control signal to the controller of the ECM, for example the motor controller 955 in the ECM which can contain power electronics and controls commutation, shown by block 960. The control signal can include instructions to rotate the ECM rotor the particular number of rotations or instructions regarding the desired eccentric ring rotation, drilling shaft receiver position, or desired deflection and/or azimuthal direction, as well as other instructions related to control of the mechanical actuator. The controller in block 960 can include for example the motor controller of the ECM.

Once the control signal is received by the ECM controller as in block 960, a motor drive signal is then sent to the ECM as in block 970 to drive the rotor 910 the particular number of rotations and position the ECM rotor 910 to achieve the desired eccentric ring rotation. The rotor 910 is the mechanical output of the ECM in block 970 which is coupled to the actuator, i.e. eccentric rings, of block 980. Due to the fixed gear ratio between the ECM and the eccentric rings as discussed above, the number of ECM rotor rotations to achieve the desired eccentric ring rotation is known or determined by the motor controller. Accordingly, as shown in block 980 the mechanical output of the ECM rotor rotation will be to correspondingly drive the mechanical actuator, i.e. the eccentric rings.

Additional feedback loops can include motor feedback as shown by the arrow from block 970 to block 960. Such feedback can include the position of the rotor in the ECM, as determined by for example a resolver or Hall effect sensor discussed previously. This positional information is provided to the ECM controller in block 960. This positional information is used by the ECM controller in block 960 to commutate the rotor as well as calculate the cumulated position of the rotor. Such positional information and cumulated position of the rotor can also be correspondingly used to calculate the position of the mechanical actuator, i.e., the eccentric ring, the drilling shaft receiver, the shaft, and/or the degree of deflection and azimuthal rotation. The same information provided to the ECM controller in 960 as well as the determinations made by the controller can be sent to the system controller, as shown by the arrow from block 960 to block 950. Alternatively, or additionally, the determinations made at block 980 can also be carried out by the system controller.

As further shown in FIG. 7, and illustrated by the arrow extending from block 980 to block 950, there can optionally be feedback information of the position of the mechanical actuator. This can include Hall effect sensors and/or magnets or other sensors indicating the position or absolution position of the eccentric ring. There can also be sensors for determining the deflection of the shaft or the azimuthal direction.

The system controller can display this information to the operator, or use the same as a basis for calculating other drill operations involving the drill string.

Despite the lack of need for sensors, they can still be employed. For example, the rotary steerable drilling device 20 can include a drilling string orientation sensor apparatus (376) or have a housing orientation sensor apparatus 364 as described previously.

In view of the above, the drive assembly 750, based on the number of motor rotations and fixed gear ratio, can therefore actuate the eccentric rings to reflect a desired orientation while taking into consideration the orientation of the drilling string 25, the orientation of the housing 46 and the orientation of the deflection assembly 92 relative to the housing (46). This can be done by reliance on sensors and/or the rotational information of the ECM as discussed above.

Controllers

The one or more ECM(s) employed for control of the deflection device 750 include a motor controller or controller for implementing control of the motor. Each ECM can have a local motor controller and/or there can be a global controller which directly controls the components of both motors or interfaces with the local ECM motor controllers and accordingly receives and sends data and instructions to and from either local units. The global controller can be within the rotary steerable device 20 and interact with the surface operator controller, or the surface operator controller can be the global controller or a series of controllers on the surface and drill string. The controllers alone or together implement instructions for rotation of the motor rotor which communicate with the eccentric rings or other mechanical actuator for deflection and rotation of the shaft.

The controllers implementing the processes according to the present disclosure can include hardware, firmware and/or software, and can take any of a variety of form factors. In particular, such control units herein can include at least one processor optionally coupled directly or indirectly to memory elements through a system bus, as well as program code for executing and carrying out processes described herein. A "processor" as used herein is an electronic circuit that can make determinations based upon inputs. A processor can include a microprocessor, a microcontroller, and a central processing unit, among others. While a single processor can be used, the present disclosure can be implemented over a plurality of processors. For example, the plurality of processors can include the local motor controllers of the ECMs, a global controller and/or the surface operator controller, or a single controller can be employed. Accordingly, for purposes of this disclosure when referring to a motor controller, this includes the local motor controller of one or both ECM or any other controller or plurality of controllers on the surface, in the drill string or rotary steerable drill. Moreover, the controllers can also include circuits configured for performing the processes disclosed herein.

The memory elements can be a computer-usable or computer-readable medium for storing program code for use by or in connection with one or more computers or processors. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. The program code can be software, which includes but is not limited to firmware, resident software, microcode, a Field Programmable Gate Array (FPGA) or Application-Specific Integrated Circuit (ASIC) and the like. Implementation can take the forms of hardware, software or both hardware and software elements. Moreover, the controllers can be communicatively connected, including for example input and output devices coupled either directly or through intervening I/O controllers, or otherwise including connections to the stator, rotor, sensors, displays, communication devices, or other components of the rotary steerable unit or drilling shaft deflection device to receive signals, and/or data regarding such components.

Drill String and Rotary Steering Device

Figure 8:
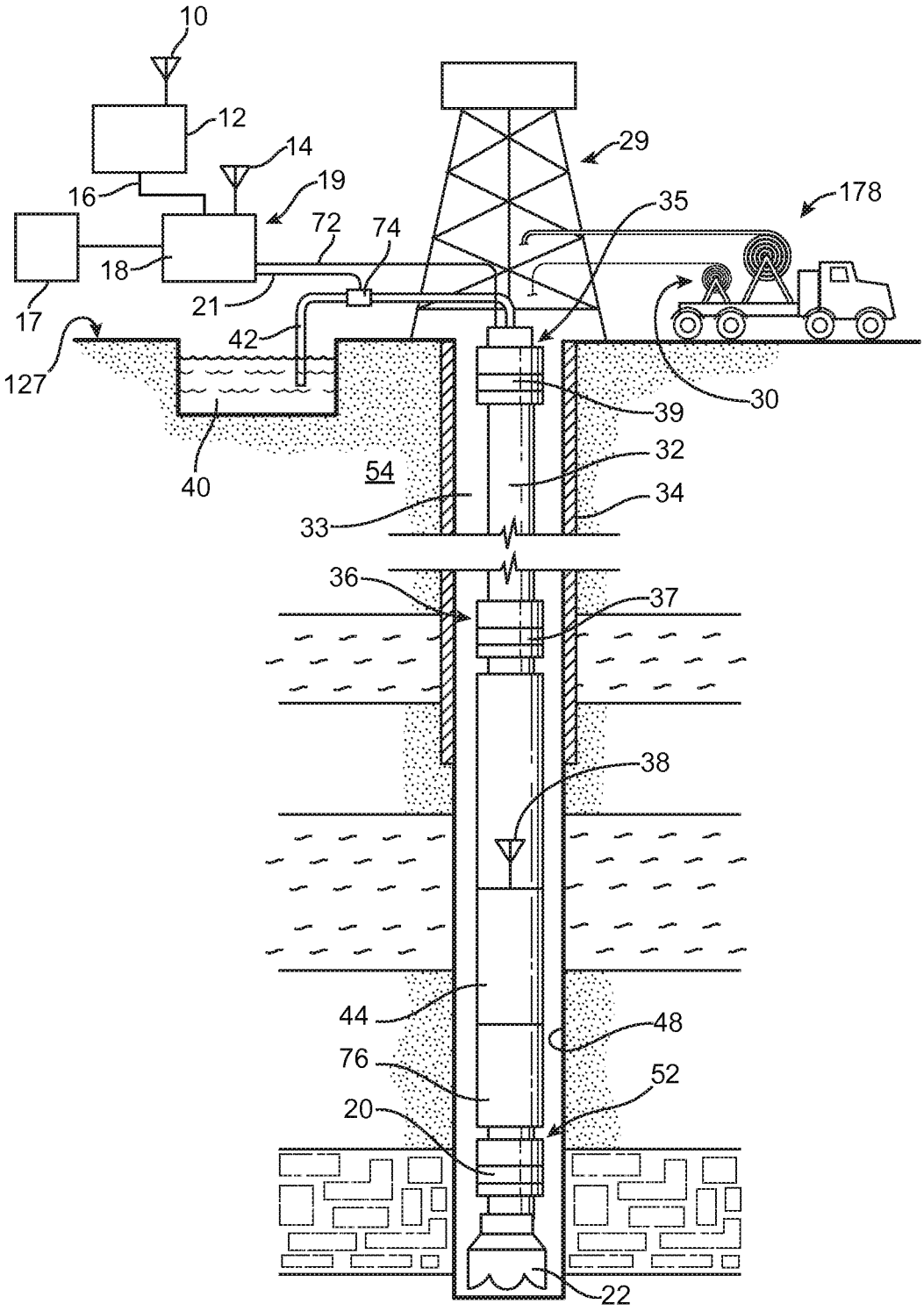
FIG. 8 is a diagram of an embodiment of a drilling rig for drilling a wellbore with the drilling system in accordance with the principles of the present disclosure

The drilling shaft deflection device 750 as disclosed herein may be implemented in rotary steerable subterranean drill 20 for use in a subterranean well that is depicted schematically in FIG. 8. A wellbore 48 is shown that has been drilled into the earth 54 from the ground's surface 127 using a drill bit 22. The drill bit 22 is located at the bottom, distal end of the drill string 32 and the bit 22 and drill string 32 are being advanced into the earth 54 by the drilling rig 29. The drilling rig 29 can be supported directly on land as shown or on an intermediate platform if at sea. For illustrative purposes, the top portion of the well bore includes casing 34 that is typically at least partially made up of cement and which defines and stabilizes the wellbore after being drilled.

As shown in FIG. 8, the drill string 32 supports several components along its length. A sensor sub-unit 52 is shown for detecting conditions near the drill bit 22, conditions which can include such properties as formation fluid density, temperature and pressure, and azimuthal orientation of the drill bit 22 or string 32. In the case of directional drilling, measurement while drilling (MWD)/logging while drilling (LWD) procedures are supported both structurally and communicatively. The instance of directional drilling is illustrated in FIG. 8. The lower end portion of the drill string 32 can include a drill collar proximate the drilling bit 22 and a rotary steerable drilling device 20. The drill bit 22 may take the form of a roller cone bit or fixed cutter bit or any other type of bit known in the art. The sensor sub-unit 52 is located in or proximate to the rotary steerable drilling device 20 and advantageously detects the azimuthal orientation of the rotary steerable drilling device 20. Other sensor sub-units 35, 36 are shown within the cased portion of the well which can be enabled to sense nearby characteristics and conditions of the drill string, formation fluid, casing and surrounding formation. Regardless of which conditions or characteristics are sensed, data indicative of those conditions and characteristics is either recorded downhole, for instance at the processor 44 for later download, or communicated to the surface either by wire using repeaters 37, 39 up to surface wire 72, or wirelessly or otherwise. If wirelessly, the downhole transceiver (antenna) 38 can be utilized to send data to a local processor 18, via topside transceiver (antenna) 14. There the data may be either processed or further transmitted along to a remote processor 12 via wire 16 or wirelessly via antennae 14 and 10.

Coiled tubing 178 and wireline 30 can be deployed as an independent service upon removal of the drill string 32. The possibility of an additional mode of communication is contemplated using drilling mud 40 that is pumped via conduit 42 to a downhole mud motor 76. The drilling mud is circulated down through the drill string 32 and up the annulus 33 around the drill string 32 to cool the drill bit 22 and remove cuttings from the wellbore 48. For purposes of communication, resistance to the incoming flow of mud can be modulated downhole to send backpressure pulses up to the surface for detection at sensor 74, and from which representative data is sent along communication channel 21 (wired or wirelessly) to one or more processors 18, 12 for recordation and/or processing.

The sensor sub-unit 52 is located along the drill string 32 above the drill bit 22. The sensor sub-unit 36 is shown in FIG. 8 positioned above the mud motor 76 that rotates the drill bit 22. Additional sensor sub-units 35, 36 can be included as desired in the drill string 32. The sub-unit 52 positioned below the motor 76 communicates with the sub-unit 36 in order to relay information to the surface 127.

A surface installation 19 is shown that sends and receives data to and from the well. The surface installation 19 can exemplarily include a local processor 18 that can optionally communicate with one or more remote processors 12, 17 by wire 16 or wirelessly using transceivers 10, 14.

The exemplary rotary steerable drilling device 20 schematically shown in FIG. 8 can also be referred to as a drilling direction control device or system. As shown, the rotary drilling device 20 is positioned on the drill string 32 with drill bit 22. However, one of skill in the art will recognize that the positioning of the rotary steerable drilling device 20 on the drill string 22 and relative to other components on the drill string 22 may be modified while remaining within the scope of the present disclosure.

Numerous examples are provided herein to enhance understanding of the present disclosure. A specific set of examples are provided as follows. In a first example, a method for determining a configuration of a mechanical actuator coupled to a drilling shaft in a drilling shaft deflection device of a rotary steerable subterranean drill is disclosed, the method including: receiving, at a controller, data representative of a present rotary position of a rotor of an electronically commutated deflector motor of a drilling shaft deflection device of a rotary steerable subterranean drill, the rotor being operatively coupled by a fixed-ratio transmission to a mechanical actuator including a drilling shaft receiver coupled about a portion of a deflectable drilling shaft of the drilling shaft deflection device; and determining, at the controller, the present position of the drilling shaft receiver in dependence upon the received data representative of the present rotary position of the rotor of the electronically commutated deflector motor.

In a second example, a method is disclosed according to the first example, further including receiving, at the controller, data representative of at least a first rotary position and a second rotary position of the rotor, wherein the second rotary position is the present rotary position of the rotor of the electronically commutated deflector motor; determining, at the controller, an amount of rotation experienced by the rotor revolving from the first rotary position to the second rotary position; and wherein the present position of the drilling shaft receiver is determined, at the controller, in dependence upon the determined amount of rotation experienced by the rotor revolving from the first rotary position to the second rotary position.

In a third example, a method is disclosed according to the first or second examples, further including generating the data representative of at least the first rotary position and the second rotary position of the rotor by a resolver associated with the electronically commutated deflector motor.

In a fourth example, a method is disclosed according to any of the preceding examples first to the third, wherein the present position of the drilling shaft receiver is determined, at the controller, in dependence upon the received data representative of the second rotary position of the rotor.

In a fifth example, a method is disclosed according to any of the preceding examples first to the fourth, further including determining, at the controller, movement of the drilling shaft receiver that is induced, via the transmission, by the determined amount of rotation experienced by the rotor revolving from the first rotary position to the second rotary position.

In a sixth example, a method is disclosed according to any of the preceding examples first to the fifth, further including determining, at the controller, an amount of movement of the drilling shaft receiver along a known path that is induced, via the transmission, by the determined amount of rotation experienced by the rotor revolving from the first rotary position to the second rotary position.

In a seventh example, a method is disclosed according to any of the preceding examples first to the sixth, further including determining, at the controller, an amount of movement of the drilling shaft receiver along a known path that is induced, via the transmission, by applying a transmission ratio to the determined amount of rotation experienced by the rotor revolving from the first to the second rotary position.

In an eighth example, a method is disclosed according to any of the preceding examples first to the seventh, further including generating the data representative of the present rotary position of the rotor by a resolver associated with the electronically commutated deflector motor.

In a ninth example, a method is disclosed according to any of the preceding examples first to the eighth, further including receiving, at the controller, data representative of a start rotary position of the rotor; receiving, at the controller, data representative of sequential, post-start rotary positions of the rotor from the start rotary position through the present rotary position; and determining, at the controller, a cumulated amount of post-start rotation, from the start rotary position of the rotor through the present rotary position of the rotor, experienced by the rotor in dependence upon the received data representative of the start rotary position of the rotor and the received data representative of the sequential, post-start rotary positions of the rotor.

In a tenth example, a method is disclosed according to any of the preceding examples first to the ninth, further including receiving, at the controller, data representative of a start position of the drilling shaft receiver corresponding to the start rotary position of the rotor; and determining, at the controller, the present position of the drilling shaft receiver in dependence upon the determined cumulated amount of post-start rotation experienced by the rotor.

In an eleventh example, a method is disclosed according to any of the preceding examples first to the tenth, further including determining, at the controller, an amount of post-start movement of the drilling shaft receiver along a known path that is induced, via the transmission, by applying a transmission ratio to the determined cumulated amount of post-start rotation experienced by the rotor.

In a twelfth example, a method is disclosed according to any of the preceding examples first to the eleventh, further including receiving, at the controller, data representative of the start position of the drilling shaft receiver from a sensor at the mechanical actuator.

In a thirteenth example, a method is disclosed according to any of the preceding examples first to the twelfth, wherein the sensor at the mechanical actuator is a Hall effect sensor.

In a fourteenth example, a method is disclosed according to any of the preceding examples first to the thirteenth, wherein the electronically commutated motor is a brushless direct current motor.

In a fifteenth example, a method is disclosed according to any of the preceding examples first to the fourteenth, further including, utilizing the drilling shaft deflection device, establishing an instructed deflection angle and azimuthal toolface direction of a drill bit in the rotary steerable subterranean drill, the drilling shaft deflection device including, a drilling shaft rotatably supported in a drilling shaft housing; a drilling shaft deflection assembly including an outer eccentric ring and an inner eccentric ring that engages the drilling shaft; and a pair of drive motors anchored relative the housing and respectively coupled, one each, to the inner and outer eccentric rings for rotating each eccentric ring in two directions.

In a sixteenth example, a method is disclosed according to any of the preceding examples first to the fifteenth, wherein the drilling shaft deflection device further includes the housing being generally cylindrical shaped and having a longitudinal centerline, the longitudinal centerlines of the drilling shaft and housing being substantially coincident when the drilling shaft is undeflected within the housing; the drilling shaft deflection assembly contained within the housing for transitioning the drilling shaft between deflected and undeflected configurations; the outer eccentric ring being rotatably supported at an inner peripheral surface of the housing and having a circular inner peripheral surface that is eccentric with respect to the housing; the inner eccentric ring being rotatably supported at the circular inner peripheral surface of the outer eccentric ring and having a circular inner peripheral surface that engages the drilling shaft and which is eccentric with respect to the circular inner peripheral surface of the outer eccentric ring; and one of the pair of motors drivingly coupled by a first transmission to the outer eccentric ring and which rotates the outer eccentric ring in a first direction and an opposite, second direction relative to the housing and the other of the pair of motors drivingly coupled by a second transmission to the inner eccentric ring and which rotates the inner eccentric ring in a first direction and an opposite, second direction relative to the outer eccentric ring.

In a seventeenth example, a method is disclosed according to the sixteenth example, wherein the first transmission coupling one of the pair of motors to the outer eccentric ring includes a driveshaft coupled to and driven by the motor and a pinion gear engaged with a spur gear coupled to and driving the outer eccentric ring.

In an eighteenth example, a method is disclosed according to the sixteenth or seventeenth examples, wherein the second transmission coupling one of the pair of motors to the inner eccentric ring includes a driveshaft coupled to and driven by the motor and a pinion gear engaged with a spur gear coupled to and driving the inner eccentric ring.

In a nineteenth example, a method is disclosed according to any of the preceding examples sixteenth to the eighteenth, wherein the first transmission coupling a first of the pair of motors to the outer eccentric ring includes a first driveshaft coupled to and driven by the first motor and a first pinion gear engaged with a first spur gear coupled to and driving the outer eccentric ring, and the second transmission coupling a second of the pair of motors to the inner eccentric ring includes a second driveshaft coupled to and driven by the second motor and a second pinion gear engaged with a second spur gear coupled to and driving the inner eccentric ring.

In a twentieth example, a system is disclosed including a drill string having a rotary steerable subterranean drill; an electronically commutated deflector motor having a rotor; a mechanical actuator having a drilling shaft receiver coupled about a portion of a deflectable drilling shaft of the rotary steerable subterranean drill, the rotor being operatively coupled by a fixed-ratio transmission to the mechanical actuator; a controller is configured to receive data representative of a present rotary position of the rotor and determine the present position of the drilling shaft receiver in dependence upon the received data representative of the present rotary position of the rotor of the electronically commutated deflector motor.

In a twenty first example, a system is disclosed according to the twentieth example, wherein the controller determines an amount of rotation experienced by the rotor revolving from a first rotary position to a second rotary position; and wherein the present position of the drilling shaft receiver is determined, at the controller, in dependence upon the determined amount of rotation experienced by the rotor revolving from the first rotary position to the second rotary position.

In a twenty second example, a system is disclosed according to the twentieth or twenty first examples, wherein the electronically commutated motor is a brushless direct current motor.

In a twenty third example, a system is disclosed according to any of the preceding examples twentieth to the twenty second, wherein the electronically commutated deflector motor includes a resolver for generating the data representative of the present rotary position of the rotor.

In a twenty fourth example, a system is disclosed according to any of the preceding examples twentieth to the twenty third, wherein the drill string extends from a surface of the earth to within a subterranean formation, the controller being located at least in part along a subterranean portion of the drill string.

In a twenty fifth example, a system is disclosed according to any of the preceding examples twentieth to the twenty fourth wherein the drill string extends from a surface of the earth to within a subterranean formation, the controller being located at least in part on the surface.

In a twenty sixth example a system is disclosed according to any of the preceding examples twentieth to the twenty fifth, further including a drilling shaft rotatably supported in a drilling shaft housing; a drilling shaft deflection assembly including an outer eccentric ring and an inner eccentric ring that engages the drilling shaft; and a pair of drive motors anchored relative the housing and respectively coupled, one each, to the inner and outer eccentric rings for rotating each eccentric ring in two directions.

In a twenty seventh example, a system is disclosed according to the twenty sixth example, further including the housing being generally cylindrical shaped and having a longitudinal centerline, the longitudinal centerlines of the drilling shaft and housing being substantially coincident when the drilling shaft is undeflected within the housing; the drilling shaft deflection assembly contained within the housing for transitioning the drilling shaft between deflected and undeflected configurations; the outer eccentric ring being rotatably supported at an inner peripheral surface of the housing and having a circular inner peripheral surface that is eccentric with respect to the housing; the inner eccentric ring being rotatably supported at the circular inner peripheral surface of the outer eccentric ring and having a circular inner peripheral surface that engages the drilling shaft and which is eccentric with respect to the circular inner peripheral surface of the outer eccentric ring; and one of the pair of motors drivingly coupled by a first transmission to the outer eccentric ring and which rotates the outer eccentric ring in a first direction and an opposite, second direction relative to the housing and the other of the pair of motors drivingly coupled by a second transmission to the inner eccentric ring and which rotates the inner eccentric ring in a first direction and an opposite, second direction relative to the outer eccentric ring.

In a twenty eighth example, a system is disclosed according to the twenty sixth or twenty seventh examples, wherein the first transmission coupling one of the pair of motors to the outer eccentric ring includes a driveshaft coupled to and driven by the motor and a pinion gear engaged with a spur gear coupled to and driving the outer eccentric ring.

In a twenty ninth example, a system is disclosed according to any of the preceding examples twenty sixth to the twenty eighth examples, wherein the second transmission coupling one of the pair of motors to the inner eccentric ring includes a driveshaft coupled to and driven by the motor and a pinion gear engaged with a spur gear coupled to and driving the inner eccentric ring.

In a thirtieth example, a system is disclosed according to any of the preceding examples twenty sixth to the twenty ninth, wherein the first transmission coupling a first of the pair of motors to the outer eccentric ring includes a first driveshaft coupled to and driven by the first motor and a first pinion gear engaged with a first spur gear coupled to and driving the outer eccentric ring, and the second transmission coupling a second of the pair of motors to the inner eccentric ring includes a second driveshaft coupled to and driven by the second motor and a second pinion gear engaged with a second spur gear coupled to and driving the inner eccentric ring.

The embodiments shown and described above are only examples. Many details are often found in the art such as the other features of a logging system. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A method for determining a configuration of a mechanical actuator coupled to a drilling shaft in a drilling shaft deflection device of a rotary steerable subterranean drill, the method comprising:

receiving, at a controller, data representative of a commutation information of an electronically commutated deflector motor of a drilling shaft deflection device of a rotary steerable subterranean drill, the electronically commutated deflector motor being operatively coupled by a fixed-ratio transmission to a mechanical actuator comprising a drilling shaft receiver coupled about a portion of a deflectable drilling shaft of the drilling shaft deflection device; and determining, at the controller, the present position of the drilling shaft receiver in dependence upon the received data representative of the commutation information of the electronically commutated deflector motor.

2. The method of claim 1, further comprising:

generating the data representative of the present rotary position of the rotor by a resolver associated with the electronically commutated deflector motor.

3. The method of claim 1, further comprising:

receiving, at the controller, data representative of a start rotary position of the rotor;

receiving, at the controller, data representative of sequential, post-start rotary positions of the rotor from the start rotary position through the present rotary position; and determining, at the controller, a cumulated amount of post-start rotation, from the start rotary position of the rotor through the present rotary position of the rotor, experienced by the rotor in dependence upon the received data representative of the start rotary position of the rotor and the received data representative of the sequential, post-start rotary positions of the rotor.

4. The method of claim 3, further comprising:

receiving, at the controller, data representative of a start position of the drilling shaft receiver corresponding to the start rotary position of the rotor; and determining, at the controller, the present position of the drilling shaft receiver in dependence upon the determined cumulated amount of post-start rotation experienced by the rotor.

5. The method of claim 4, further comprising:

determining, at the controller, an amount of post-start movement of the drilling shaft receiver along a known path that is induced, via the transmission, by applying a transmission ratio to the determined cumulated amount of post-start rotation experienced by the rotor.

6. The method of claim 4, further comprising:

receiving, at the controller, data representative of the start position of the drilling shaft receiver from a sensor at the mechanical actuator.

7. The method of claim 6, wherein the sensor at the mechanical actuator is a Hall effect sensor.

8. The method of claim 1, wherein the electronically commutated motor is a brushless direct current motor.

9. The method of claim 1, further comprising:

utilizing the drilling shaft deflection device, establishing an instructed deflection angle and azimuthal toolface direction of a drill bit in the rotary steerable subterranean drill, the drilling shaft deflection device comprising:

a drilling shaft rotatably supported in a drilling shaft housing;

a drilling shaft deflection assembly comprising an outer eccentric ring and an inner eccentric ring that engages the drilling shaft; and a pair of drive motors anchored relative the housing and respectively coupled, one each, to the inner and outer eccentric rings for rotating each eccentric ring in two directions.

10. The method of claim 9, wherein the drilling shaft deflection device further comprises:

the housing being generally cylindrical shaped and having a longitudinal centerline, the longitudinal centerlines of the drilling shaft and housing being substantially coincident when the drilling shaft is undeflected within the housing;

the drilling shaft deflection assembly contained within the housing for transitioning the drilling shaft between deflected and undeflected configurations;

the outer eccentric ring being rotatably supported at an inner peripheral surface of the housing and having a circular inner peripheral surface that is eccentric with respect to the housing;

the inner eccentric ring being rotatably supported at the circular inner peripheral surface of the outer eccentric ring and having a circular inner peripheral surface that engages the drilling shaft and which is eccentric with respect to the circular inner peripheral surface of the outer eccentric ring; and one of the pair of motors drivingly coupled by a first transmission to the outer eccentric ring and which rotates the outer eccentric ring in a first direction and an opposite, second direction relative to the housing and the other of the pair of motors drivingly coupled by a second transmission to the inner eccentric ring and which rotates the inner eccentric ring in a first direction and an opposite, second direction relative to the outer eccentric ring.

11. The method of claim 10, wherein the first transmission coupling one of the pair of motors to the outer eccentric ring comprises a driveshaft coupled to and driven by the motor and a pinion gear engaged with a spur gear coupled to and driving the outer eccentric ring.

12. The method of claim 10, wherein the second transmission coupling one of the pair of motors to the inner eccentric ring comprises a driveshaft coupled to and driven by the motor and a pinion gear engaged with a spur gear coupled to and driving the inner eccentric ring.

13. The method of claim 10, wherein the first transmission coupling a first of the pair of motors to the outer eccentric ring comprises a first driveshaft coupled to and driven by the first motor and a first pinion gear engaged with a first spur gear coupled to and driving the outer eccentric ring, and the second transmission coupling a second of the pair of motors to the inner eccentric ring comprises a second driveshaft coupled to and driven by the second motor and a second pinion gear engaged with a second spur gear coupled to and driving the inner eccentric ring.

14. The method of claim 10, wherein each of the inner eccentric ring and outer eccentric ring are rotatable while the inner peripheral surface engages the drilling shaft.

15. The method of claim 1, wherein the commutation information comprises a present rotary position of a rotor internal to the electronically commutated deflector motor.

16. The method of claim 15, further comprising:

receiving, at the controller, data representative of at least a first rotary position and a second rotary position of the rotor, wherein the second rotary position is the present rotary position of the rotor of the electronically commutated deflector motor;

determining, at the controller, an amount of rotation experienced by the rotor revolving from the first rotary position to the second rotary position; and wherein the present position of the drilling shaft receiver is determined, at the controller, in dependence upon the determined amount of rotation experienced by the rotor revolving from the first rotary position to the second rotary position.

17. The method of claim 16, further comprising:

generating the data representative of at least the first rotary position and the second rotary position of the rotor by a resolver associated with the electronically commutated deflector motor.

18. The method of claim 16, wherein the present position of the drilling shaft receiver is determined, at the controller, in dependence upon the received data representative of the second rotary position of the rotor.

19. The method of claim 16, further comprising:

determining, at the controller, movement of the drilling shaft receiver that is induced, via the transmission, by the determined amount of rotation experienced by the rotor revolving from the first rotary position to the second rotary position.

20. The method of claim 16, further comprising:

determining, at the controller, an amount of movement of the drilling shaft receiver along a known path that is induced, via the transmission, by the determined amount of rotation experienced by the rotor revolving from the first rotary position to the second rotary position.

21. The method of claim 16, further comprising:

determining, at the controller, an amount of movement of the drilling shaft receiver along a known path that is induced, via the transmission, by applying a transmission ratio to the determined amount of rotation experienced by the rotor revolving from the first to the second rotary position.

22. The method of claim 1, wherein the commutation information of is obtained by a resolver integral with the electronically commutated deflector motor.

23. The method of claim 1, wherein the commutation information of is received without the use of a positional sensor.

24. A system comprising:

a drill string having a rotary steerable subterranean drill;

an electronically commutated deflector motor having a rotor;

a mechanical actuator having a drilling shaft receiver coupled about a portion of a deflectable drilling shaft of the rotary steerable subterranean drill, the rotor being operatively coupled by a fixed-ratio transmission to the mechanical actuator; and a controller configured to receive data representative of a commutation information of the electronically commutated deflector motor and determine the present position of the drilling shaft receiver in dependence upon the received data representative of the commutation information of the electronically commutated deflector motor.

25. The system of claim 24, wherein the controller determines an amount of rotation experienced by the rotor revolving from a first rotary position to a second rotary position; and wherein the present position of the drilling shaft receiver is determined, at the controller, in dependence upon the determined amount of rotation experienced by the rotor revolving from the first rotary position to the second rotary position.

26. The system of claim 24, wherein the electronically commutated motor is a brushless direct current motor.

27. The system of claim 24, wherein the electronically commutated deflector motor comprises a resolver for generating the data representative of the present rotary position of the rotor.

28. The system of claim 24, wherein the drill string extends from a surface of the earth to within a subterranean formation, the controller being located at least in part along a subterranean portion of the drill string.

29. The system of claim 24, wherein the drill string extends from a surface of the earth to within a subterranean formation, the controller being located at least in part on the surface.

30. The system of claim 24, further comprising:

a drilling shaft rotatably supported in a drilling shaft housing;

a drilling shaft deflection assembly comprising an outer eccentric ring and an inner eccentric ring that engages the drilling shaft; and a pair of drive motors anchored relative the housing and respectively coupled, one each, to the inner and outer eccentric rings for rotating each eccentric ring in two directions.

31. The system of claim 30, further comprising:

the housing being generally cylindrical shaped and having a longitudinal centerline, the longitudinal centerlines of the drilling shaft and housing being substantially coincident when the drilling shaft is undeflected within the housing;

the drilling shaft deflection assembly contained within the housing for transitioning the drilling shaft between deflected and undeflected configurations;

the outer eccentric ring being rotatably supported at an inner peripheral surface of the housing and having a circular inner peripheral surface that is eccentric with respect to the housing;

the inner eccentric ring being rotatably supported at the circular inner peripheral surface of the outer eccentric ring and having a circular inner peripheral surface that engages the drilling shaft and which is eccentric with respect to the circular inner peripheral surface of the outer eccentric ring; and one of the pair of motors drivingly coupled by a first transmission to the outer eccentric ring and which rotates the outer eccentric ring in a first direction and an opposite, second direction relative to the housing and the other of the pair of motors drivingly coupled by a second transmission to the inner eccentric ring and which rotates the inner eccentric ring in a first direction and an opposite, second direction relative to the outer eccentric ring.

32. The system of claim 31, wherein the first transmission coupling one of the pair of motors to the outer eccentric ring comprises a driveshaft coupled to and driven by the motor and a pinion gear engaged with a spur gear coupled to and driving the outer eccentric ring.

33. The system of claim 31, wherein the second transmission coupling one of the pair of motors to the inner eccentric ring comprises a driveshaft coupled to and driven by the motor and a pinion gear engaged with a spur gear coupled to and driving the inner eccentric ring.

34. The system of claim 31, wherein the first transmission coupling a first of the pair of motors to the outer eccentric ring comprises a first driveshaft coupled to and driven by the first motor and a first pinion gear engaged with a first spur gear coupled to and driving the outer eccentric ring, and the second transmission coupling a second of the pair of motors to the inner eccentric ring comprises a second driveshaft coupled to and driven by the second motor and a second pinion gear engaged with a second spur gear coupled to and driving the inner eccentric ring.

* * * * *